US008184844B2

(12) United States Patent
Murata

(10) Patent No.: US 8,184,844 B2
(45) Date of Patent: May 22, 2012

(54) MICROPHONE MOUNTER

(75) Inventor: Takashi Murata, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 954 days.

(21) Appl. No.: 12/222,475

(22) Filed: Aug. 11, 2008

(65) Prior Publication Data

US 2009/0067660 A1 Mar. 12, 2009

(30) Foreign Application Priority Data

Sep. 7, 2007 (JP) ..... 2007-232243

(51) Int. Cl.
*H04R 9/08* (2006.01)

(52) U.S. Cl. ..... 381/361; 381/363; 381/362

(58) Field of Classification Search ..... 248/638, 248/559, 636, 562, 566; 381/91
See application file for complete search history.

(56) References Cited

U.S. PATENT DOCUMENTS

| | | | | |
|---|---|---|---|---|
| 4,434,329 | A * | 2/1984 | Nasu | 381/354 |
| 5,988,585 | A * | 11/1999 | Eaton | 248/638 |
| 6,128,393 | A * | 10/2000 | Kondo | 381/368 |
| 7,400,739 | B2 * | 7/2008 | Akino | 381/361 |
| 2006/0078147 | A1 * | 4/2006 | Akino | 381/361 |

* cited by examiner

*Primary Examiner* — Steven Loke
*Assistant Examiner* — David Goodwin
(74) *Attorney, Agent, or Firm* — Manabu Kanesaka

(57) ABSTRACT

A microphone mounter includes a first fixture attached to an upper opening of a mounting hole formed in an installation place, and a second fixture attached to a lower opening of the mounting hole. A microphone is installed in the mounting hole via the first and second fixtures. The first fixture includes a flange part having a diameter larger than a diameter of the upper opening and provided with an insertion hole, a sleeve projecting from a lower surface of the flange part, and an anchor part integrally formed at an end of the sleeve opposite to the flange part. The anchor part has an outer peripheral surface adapted to touch an inner peripheral surface of the mounting hole and an inner peripheral surface adapted to touch an outer peripheral surface of the microphone. The outer peripheral surface projects outwardly from the end of the sleeve to the mounting hole.

8 Claims, 6 Drawing Sheets

MICROPHONE MOUNTER

TECHNICAL FIELD

The present invention relates to a microphone mounter for mounting a microphone in a mounting hole provided in an installation surface of a table or the like. More particularly, it relates to a microphone mounter in which a fixture attached to the mounting hole does not float up following the movement of the microphone.

BACKGROUND ART

A gooseneck microphone, which is slender and inconspicuous, is preferably used on a table, for example, in a conference room. For example, as described in Japanese Utility Model Application Publication No. H05-97191, in many cases, a mounting hole is formed in a table, and a microphone is fixed in the mounting hole via a dedicated mounter.

According to this microphone mounter, since the installation space can be made small, the appearance and the like on the table can be improved. However, if the mounting hole is provided and the microphone is provided directly on the table, a problem arises in that when the table is pounded, the shock thereof is immediately transmitted to the microphone.

Accordingly, a mounter as shown in FIG. 8 having a shock mount structure that makes the aforementioned shock less liable to be transmitted to the microphone has also been provided. This microphone mounter 1 includes a first fixture 2 attached to an upper opening H1 on the top surface side of a mounting hole H formed in a table T and a second fixture 3 attached to a lower opening H2 on the back surface side.

The first fixture 2 is formed by an elastic body made of vibration-proof rubber or the like having a disc shape, and in the center thereof, an insertion hole 22 through which the external cylinder of a microphone M is inserted is provided. Also, on the first fixture 2, a disc-shaped flange part 21 for closing the upper opening H1 is provided coaxially with the insertion hole 22 being the center.

On the lower surface side of the first fixture 2, a convex part 23 that is inserted in the mounting hole H is provided. The microphone M is supported by the inner peripheral surface of the insertion hole 22 and an inner peripheral surface 24 of the convex part 23 so as to be not in contact with the mounting hole H.

The second fixture 3 includes a base ring 31 arranged along the opening edge of the lower opening H2, a pressing ring 32 arranged so as to cover the base ring 31, and an elastically deformable elastic ring 33 held between the base ring 31 and the pressing ring 32 on the inner peripheral surface side thereof.

In the base ring 31 and the pressing ring 32, screw insertion holes for coaxially positioning these rings are provided, for example, at three locations at intervals of 120 degrees. Male screws 34 are screwed into the table T through the screw insertion holes from the pressing ring 32 side, and the pressing ring 32 is pressed on the base ring 31 side. Thereby, a part of the elastic ring 33 is elastically deformed to project to the inside, by which the outer periphery of the microphone M is supported.

Thereby, the microphone M is held in the mounting hole H via the vibration-proof material in a noncontact state. In this conventional example, attaching importance to the appearance of the mounter 1 on the table surface and the saving of space, the first fixture 2 is arranged on the top surface side of the table T as a decorative ring, and the second fixture 3 that substantially supports the microphone M is arranged on the back surface side of the table T.

However, in the above-described conventional microphone mounter, the first fixture 2 is not fixed to the upper opening H1 because it is used as the decorative ring for concealing the upper opening H1 of the mounting hole H. Therefore, as shown in FIG. 9, when the microphone M is moved in the substantially horizontal direction (the direction indicated by the arrow A), the first fixture 2 may float up (in the direction indicated by the arrow B).

Even if the microphone M returns to its original position, the once floating first fixture 2 does not slide down easily, so that a gap is produced between the table T and the first fixture 2. The production of gap is unfavorable in terms of appearance.

As one method for preventing the first fixture 2 from floating up, the first fixture 2 has only to be formed of a hard material, and be forcedly fitted in the mounting hole H. However, this method is unfavorable because the vibrations of the table T may be transmitted to the microphone M via the first fixture 2.

If, as another method, a portion of the first fixture 2 that fits in the mounting hole H is formed of a hard material and a portion that fits on the microphone M is formed of a soft material, the floating phenomenon can be prevented. However, the cost is increased by the use of separate materials.

Further, as still another method, a method in which the first fixture 2 is fixed via a rubber-base adhesive or the like can also be used. However, if the first fixture 2 is fixed with an adhesive, a problem arises in that the maintenance to be performed later is difficult to do.

SUMMARY OF THE INVENTION

The present invention has been made to solve the above problems, and accordingly an object thereof is to provide, at a low cost, a microphone mounter in which a fixture attached to a mounting hole does not float up or move following the movement of a microphone.

To achieve the above object, the present invention has some features described below. As a feature, the present invention provides a microphone mounter having a first fixture attached to an upper opening of a mounting hole formed in an installation surface of a table or the like and a second fixture attached to a lower opening of the mounting hole, which is configured so that a microphone is installed in the mounting hole via the first and second fixtures, wherein the first fixture has a flange part having a diameter larger than the diameter of the upper opening and provided with an insertion hole, through which the microphone is inserted, in the center thereof and a sleeve which is provided projectingly from the lower surface of the flange part and is inserted in the mounting hole in a noncontact manner; at the tip end of the sleeve, an anchor part, the outer peripheral surface of which touches along the inner peripheral surface of the mounting hole and the inner peripheral surface of which touches along the outer peripheral surface of the microphone, is provided integrally; and when the microphone is moved, the anchor part converts deformation stress applied to the anchor part into downward moment.

According to this configuration, the first fixture is provided with the anchor part at the tip end of the sleeve that is inserted in the mounting hole in a noncontact manner, the outer peripheral surface of the anchor part is brought into contact with the inner peripheral surface of the mounting hole, and the inner peripheral surface of the anchor part is brought into contact with the outer peripheral surface of the microphone.

Thereby, when the microphone is moved, deformation stress applied to the anchor part can be converted into downward moment, so that the first fixture can be prevented from floating up.

The present invention has a feature of being configured so that a part of the anchor part ranging from the outer peripheral surface of the anchor part to the inner peripheral surface of the anchor part is positioned below the position of the outer peripheral surface of the anchor part.

According to this configuration, since a part of the anchor part ranging from the outer peripheral surface of the anchor part to the inner peripheral surface of the anchor part is positioned below the position of the outer peripheral surface of the anchor part, in the case where compressive stress is applied to the anchor part, a force applied in the compression direction can be converted into downward moment because the outer peripheral surface serves as a supporting point and a point of application is provided below the outer peripheral surface of the anchor part.

The present invention has a feature of being configured so that the anchor part is formed so as to have an umbrella-shaped cross section in which the outer peripheral surface and the inner peripheral surface of the anchor part tilt to the first opening side with the tip end of the sleeve being a vertex.

According to this configuration, since the anchor part is formed so as to have an umbrella-shaped cross section in which the outer peripheral surface and the inner peripheral surface of the anchor part tilt to the first opening side with the tip end of the sleeve being a vertex, downward moment can be produced with the tip end of the anchor part being a point of application.

The present invention has a feature of being configured so that the anchor part is formed into an umbrella shape in which the outer peripheral surface of the anchor part is positioned on the upper opening side, and the inner peripheral surface of the anchor part is formed close to the lower opening.

According to this configuration, since the anchor part is formed so as to have a substantially straight line shaped cross section in which the outer peripheral surface of the anchor part is positioned on the upper opening side, and the inner peripheral surface of the anchor part is formed close to the lower opening, downward moment can be produced with the inner peripheral surface of the anchor part being a point of application.

Since the first fixture is preferably formed of a vibration-proof rubber, vibrations can be prevented effectively from being transmitted to the microphone.

The present invention has a feature of being configured so that when a friction coefficient between the outer peripheral surface of the anchor part and the inner peripheral surface of the mounting hole H is taken as $\mu 1$ and a friction coefficient between the inner peripheral surface of the anchor part and the microphone is taken as $\mu 2$, the frictional resistance of the anchor part is set so that $\mu 1 > \mu 2$.

According to this configuration, when the friction coefficient between the outer peripheral surface of the anchor part and the inner peripheral surface of the mounting hole is taken as $\mu 1$ and the friction coefficient between the inner peripheral surface of the anchor part and the microphone is taken as $\mu 2$, the frictional resistance of the anchor part is set so that $\mu 1 > \mu 2$. Therefore, the outer peripheral surface of the anchor part, which serves as a supporting point, can be prevented from shifting from the inner peripheral surface of the mounting hole.

The present invention has a feature of being configured so that the second fixture has a base ring arranged along the outer periphery of the lower opening, a pressing ring arranged so as to cover the base ring, and an elastically deformable elastic ring held between the base ring and the pressing ring on the inner peripheral surface side thereof; and a part of the elastic ring is elastically deformed by pressing the pressing ring onto the base ring side via a predetermined pressing means to support the microphone.

According to this configuration, the second fixture has the base ring arranged along the outer periphery of the lower opening, the pressing ring arranged so as to cover the base ring, and the elastically deformable elastic ring held between the base ring and the pressing ring on the inner peripheral surface side thereof. By pressing the pressing ring onto the base ring side via the predetermined pressing means, the microphone can be supported reliably, and also the vibration isolating effect can be enhanced.

DETAILED DESCRIPTION

Figure 1:
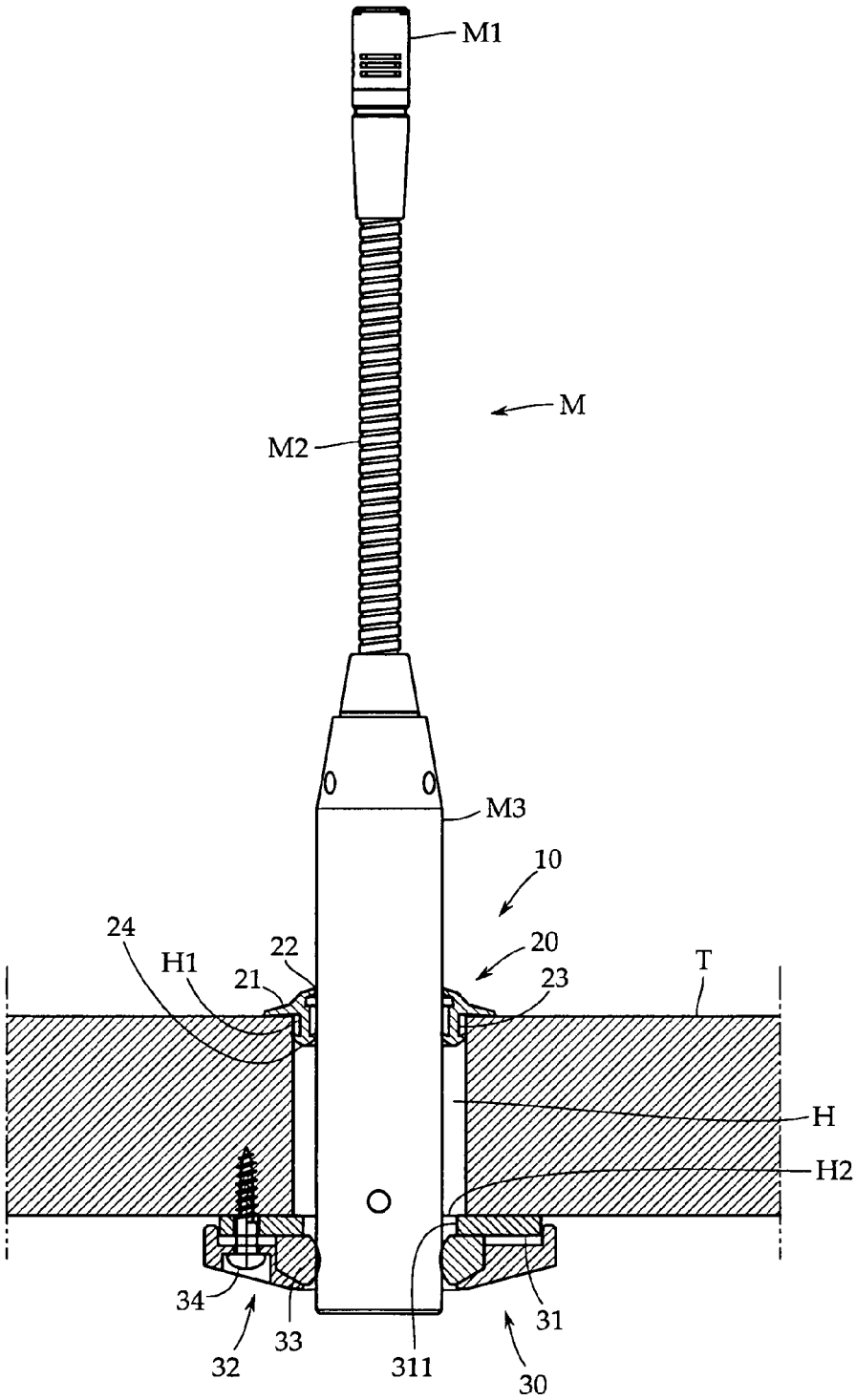
FIG. 1 is a sectional view of a microphone mounter in accordance with one embodiment of the present invention, showing a used state.
Figure 2A:
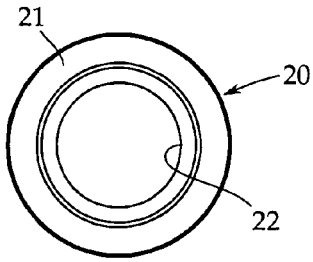
FIG. 2A is a plan view of a first fixture of the mounter shown in FIG. 1.
Figure 2B:
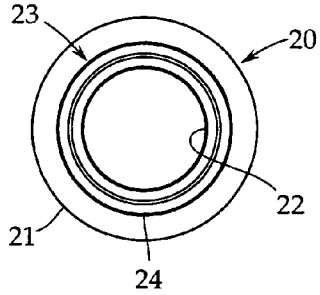
FIG. 2B is a bottom view of a first fixture of the mounter shown in FIG. 1.
Figure 2C:
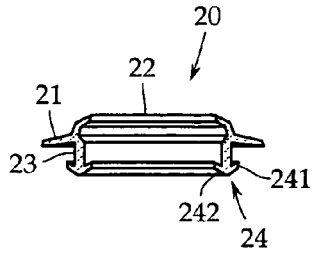
FIG. 2C is a central sectional view of a first fixture of the mounter shown in FIG. 1.
Figure 3A:
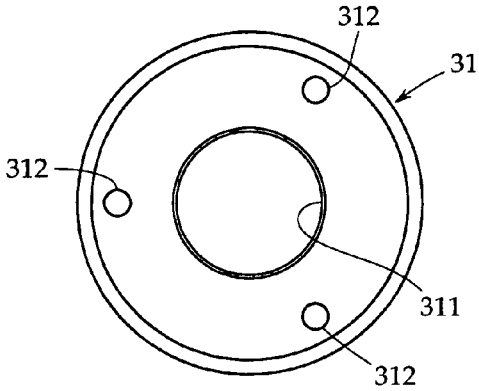
FIG. 3A is a plan view of a second fixture of the mounter shown in FIG. 1.
Figure 3B:
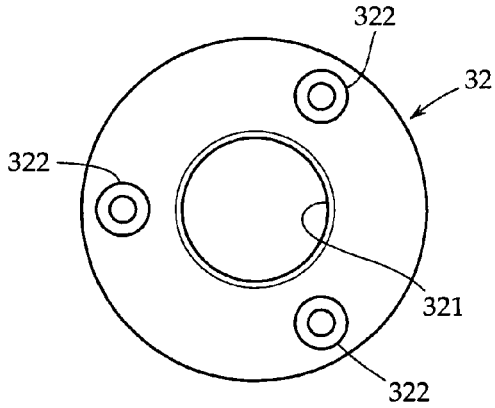
FIG. 3B is a bottom view of a second fixture of the mounter shown in FIG. 1.
Figure 3C:
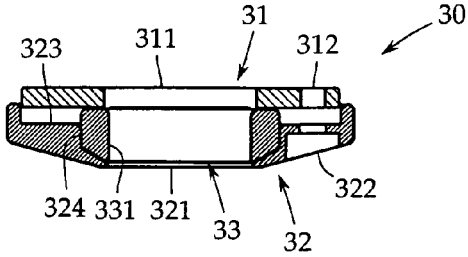
FIG. 3C is a central sectional view of a second fixture of the mounter shown in FIG. 1.

An embodiment of the present invention will now be described with reference to the accompanying drawings. The present invention is not limited to this embodiment. FIG. 1 is a sectional view of a microphone mounter in accordance with one embodiment of the present invention, showing a used state. FIGS. 2A to 2C are a plan view, a bottom view, and a central sectional view of a first fixture, respectively. FIGS. 3A to 3C are a plan view, a bottom view, and a central sectional view of a second fixture, respectively.

As shown in FIGS. 1 to 3, to support a microphone M in a mounting hole H formed in an installation surface of a table T or the like, this microphone mounter 10 includes the first fixture 20 attached to one upper opening H1 (upper opening in FIG. 1) and the second fixture 30 attached to the other lower opening H2 (lower opening in FIG. 1).

In this example, the microphone M is a gooseneck microphone in which a microphone unit M1 is attached to the tip end of a flexible pipe M2, and a cylindrical case M3 is supported at the lower end of the flexible pipe M2. To the lower end of the case M3, a microphone cable, not shown, is connected.

Since the case M3 contains an audio output circuit, a feeding transformer, and the like, the case M3 is sometimes called a power module. In the present invention, the specifications of the microphone M are optional, and the microphone M has only to be provided with a mode capable of being supported by the mounter 10.

The first fixture 20 is formed by a molded product of vibration-proof elastic rubber, and the whole thereof is formed into a cap shape. As the material for the first fixture 20, vibration-proof rubber NBR50° is preferably used. Besides, an elastic rubber material such as CR rubber, butyl rubber, or silicone rubber may be used.

Referring additionally to FIG. 2, the first fixture 20 has a disc-shaped flange part 21 having a diameter larger than the diameter of the mounting hole H. In the center of the flange part 21, an insertion hole 22 through which the case M3 of the microphone M is inserted is provided coaxially.

On the lower surface side of the first fixture 20, a sleeve 23 inserted in the mounting hole H in a noncontact manner is projectingly provided integrally. At the tip end (lower end in FIG. 2C) of the sleeve 23, an anchor part 24 having an umbrella-shaped (arrow-shaped) cross section is formed integrally.

Figure 4:
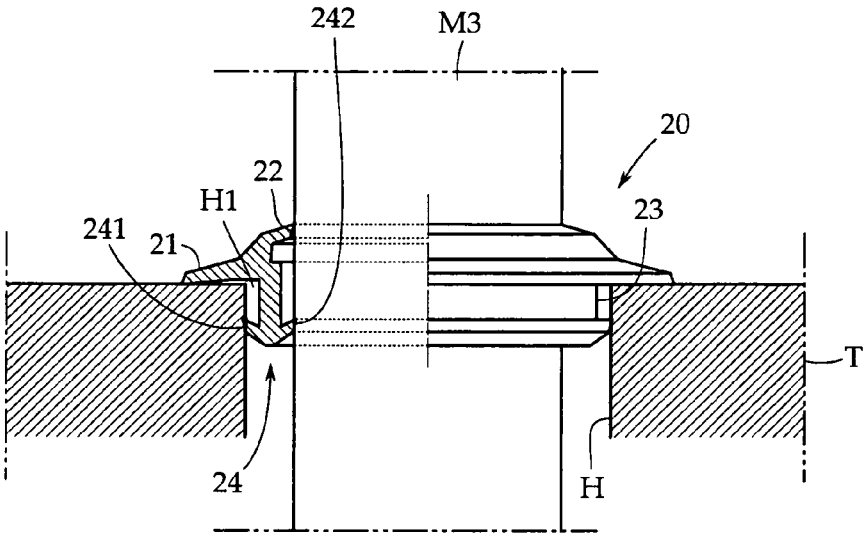
FIG. 4 is an enlarged sectional view of a first fixture, showing an installed state.

Referring to FIG. 4, the cross section of the anchor part 24 is formed into a downward arrow shape so that the anchor part 24 is easily deformed toward the sleeve insertion direction (downward direction in FIG. 2C). An outer peripheral surface 241 of the anchor part 24 touches along the inner peripheral surface of the mounting hole H.

An inner peripheral surface 242 of the anchor part 24 touches along the outer peripheral surface of the case M3 of the microphone M, so that the microphone M is supported in the mounting hole H in a noncontact state.

Next, referring to FIGS. 1 and 3, the second fixture 3 includes a base ring 31 arranged along the opening edge of the lower opening H2, a pressing ring 32 arranged so as to cover the base ring 31, and an elastically deformable elastic ring 33 held between the base ring 31 and the pressing ring 32 on the inner peripheral surface side thereof.

As shown in FIG. 3A, the base ring 31 is formed by a disc-shaped metallic ring made of, for example, aluminum. In the center of the base ring 31, an insertion hole 311 through which the case M3 of the microphone M is inserted in a noncontact manner is provided. In the base ring 31, a plurality of screw holes 312, through which screws 34 (refer to FIG. 1) are inserted, are provided. In this example, the screw holes 312 are provided at three locations at equal intervals of 120 degrees. The base ring 31 may be made of a hard plastic or the like.

As shown in FIG. 3B, like the base ring 31, the pressing ring 32 is formed, for example, by an aluminum-made ring. In the center of the pressing ring 32, an insertion hole 321 through which the case M3 of the microphone M is inserted in a noncontact manner is provided. The pressing ring 32 may be made of a hard plastic.

In the pressing ring 32, screw holes 322, through which the screws 34 are inserted, are provided at three locations at equal intervals of 120 degrees. Each of the screw holes 322 on the pressing ring 32 side is formed into a stepped screw hole to receive the screw head of the screw 34.

In the bottom surface (upper surface in FIG. 3C) of the pressing ring 32, a first concave part 323 capable of containing the base ring 31 is formed. On the inner peripheral surface side of the first concave part 323, a second concave part 324 depressed one step lower is provided. The second concave part 324 contains the elastic ring 33.

The bottom surface of the second concave part 324 is formed into a conical shape so that when the pressing ring 32 is tightened, the elastic ring 33 is expanded into the insertion hole 321 by the tightening force.

Like the first fixture 20, the elastic ring 33 is preferably formed of a vibration-proof rubber material such as NBR50°. In the center of the elastic ring 33, an insertion hole 331 having a diameter slightly larger than the diameter of the case M3 of the microphone M is formed. The material of the elastic ring 33 is not subject to any special restriction as far as it is an elastically deformable material that is held between the base ring 31 and the pressing ring 32.

A major feature of the present invention is the first fixture 20. The configuration of the second fixture 30 is not limited to the above-described embodiment, and can be changed optionally according to the specifications.

Next, one example of a procedure for using the microphone mounter 10 is explained with reference to the drawings. First, as shown in FIG. 1, the mounting hole H for mounting the microphone M is formed in the table T by using an electric drill or the like.

Then, after the base ring 31 has been positioned so that the insertion hole 311 thereof is coaxial with the lower opening H2 of the mounting hole H, the pressing ring 32 is screwed to temporarily fixing the second fixture 30 on the back surface side of the table T.

Apart from this procedure, the first fixture 20 is inserted gradually, for example, from the lower end of the case M3 of the microphone M so that the outer peripheral surface of the case M is supported by the inner peripheral surfaces of the insertion hole 22 and the anchor part 24.

In the state in which the first fixture 20 is attached to the case M3, the rear end of the case M3 is inserted from the upper opening H1 toward the lower opening H2, and the case M3 is inserted along the insertion hole 311 of the second fixture 30.

Along with this procedure, the sleeve 23 of the first fixture 20 is inserted along the upper opening H1, and the first fixture 20 stops in a state of closing the upper opening H1 with the flange part 21 being used as a stopper. At this time, since the anchor part 24 is formed into a downward arrow shape easily deformable toward the insertion direction of the sleeve 23, the anchor part 24 is easily inserted into the mounting hole H.

Subsequently, while holding the first fixture 20 with the hand, the position of the microphone M is adjusted to a predetermined height position. Thereafter, the screws 34 of the second fixture 30 are tightened gradually, by which the pressing ring 32 is moved to the base ring 31 side while narrowing the gap. Along with this movement of the pressing ring 32, the elastic ring 33 is elastically deformed gradually.

When the screws 34 are tightened further, as shown in FIG. 1, the elastic ring 33 projects to the center side while being deformed gradually, and the inner peripheral surface thereof comes into contact with the outer peripheral surface of the case M3. Thereby, the microphone M is fixed in the mounting hole H via the first and second fixtures 20 and 30 without being in contact with the inner peripheral surface of the mounting hole H.

Figure 5:
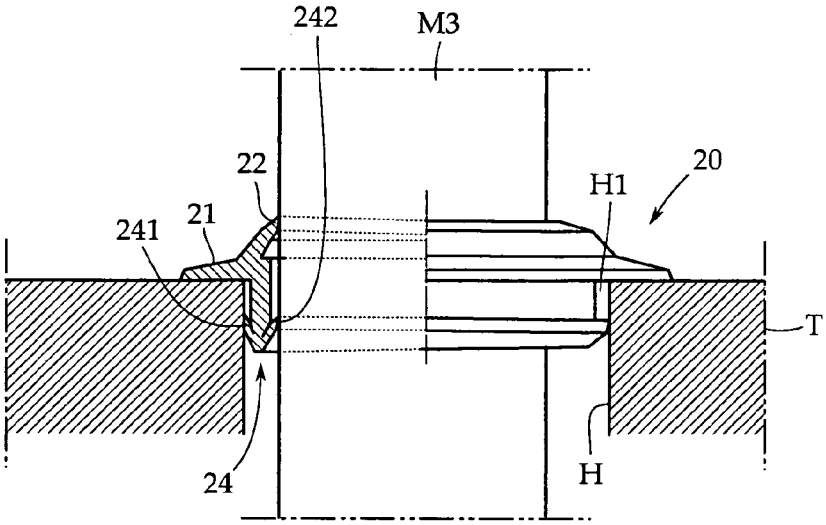
FIG. 5 is an explanatory view for explaining the operation and effect of a first fixture.
Figure 6:
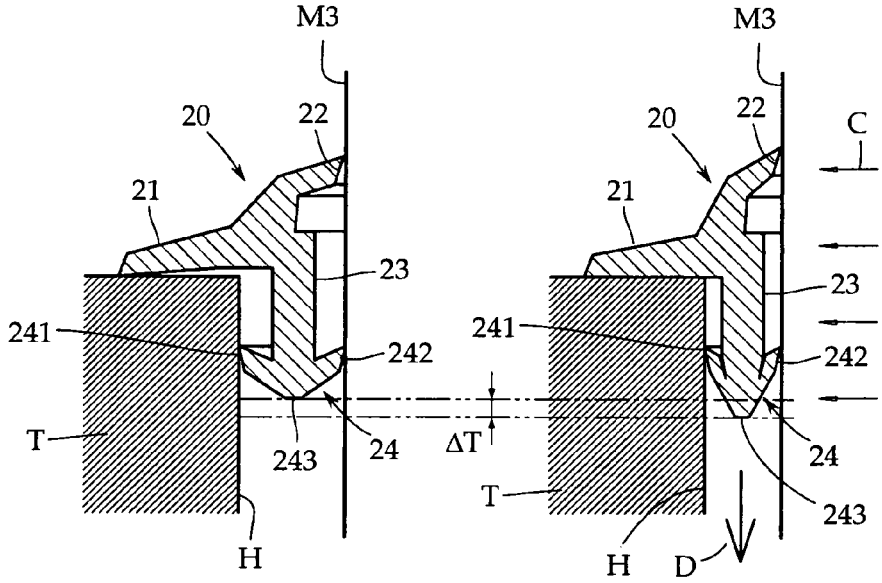
FIG. 6 is an explanatory view for explaining the operation and effect of a first fixture.

In this state, as shown in FIGS. 5 and 6, when the microphone M is moved in the substantially horizontal direction (the direction indicated by the arrows C in FIG. 6), the anchor part 24 is subjected to a compressive stress in any one direction. At this time, the relationship between a friction coefficient $\mu 1$ between the outer peripheral surface 241 of the anchor part 24 and the mounting hole H and a friction coefficient μ2 between the inner peripheral surface 242 of the anchor part 24 and the case M3 is μ1>μ2.

Therefore, if the anchor part 24 is compressed by the compressive stress, the outer peripheral surface 241 serves as a supporting point, and the tip end 243 of the anchor part 24, which is a point of application, moves downward through a distance of ΔT. Thereby, a downward force (in the direction indicated by the arrow D) is generated in the anchor part 24.

Thereby, the non-compressed side (the right-hand side in FIG. 5) is slightly moved downward by downward angular moment with the compressed side (the left-hand side in FIG. 5) being a base point, by which the first fixture 20 can be prevented form floating up.

In this embodiment, one example is given in which the mounting hole H is formed in the table T. However, the installation surface may be a ceiling or a floor surface besides the table T. Also, the installation place is not subject to any special restriction as far as the mounting hole H can be formed and the fixtures 20 and 30 can be attached to the installation place.

Also, in the above-described embodiment, the anchor part 24 is formed so as to have an arrow-shaped cross section. However, any other shape can be used if the shape offers an operation for converting the stress in the compression direction into the downward moment.

Figure 7:
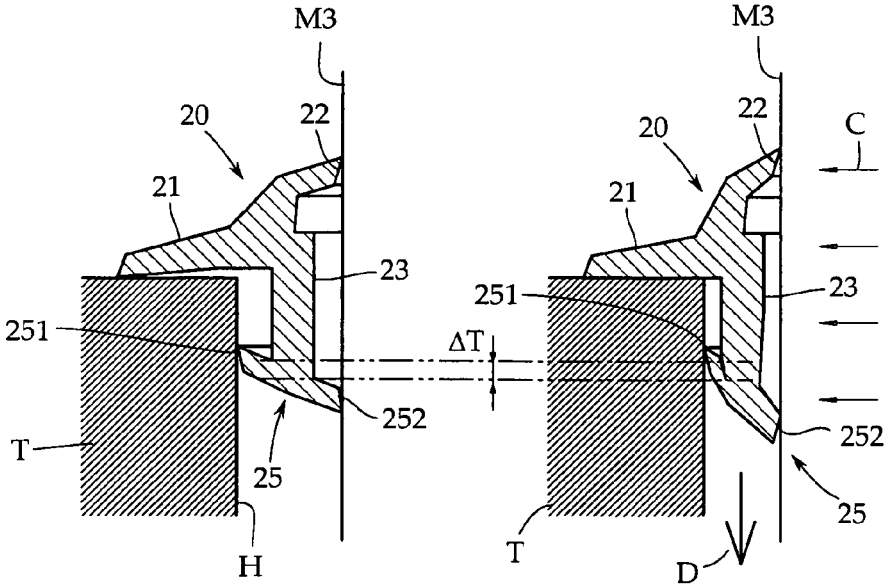
FIG. 7 is a sectional view showing a modification of an anchor part and the operation and effect thereof.
Figure 8:
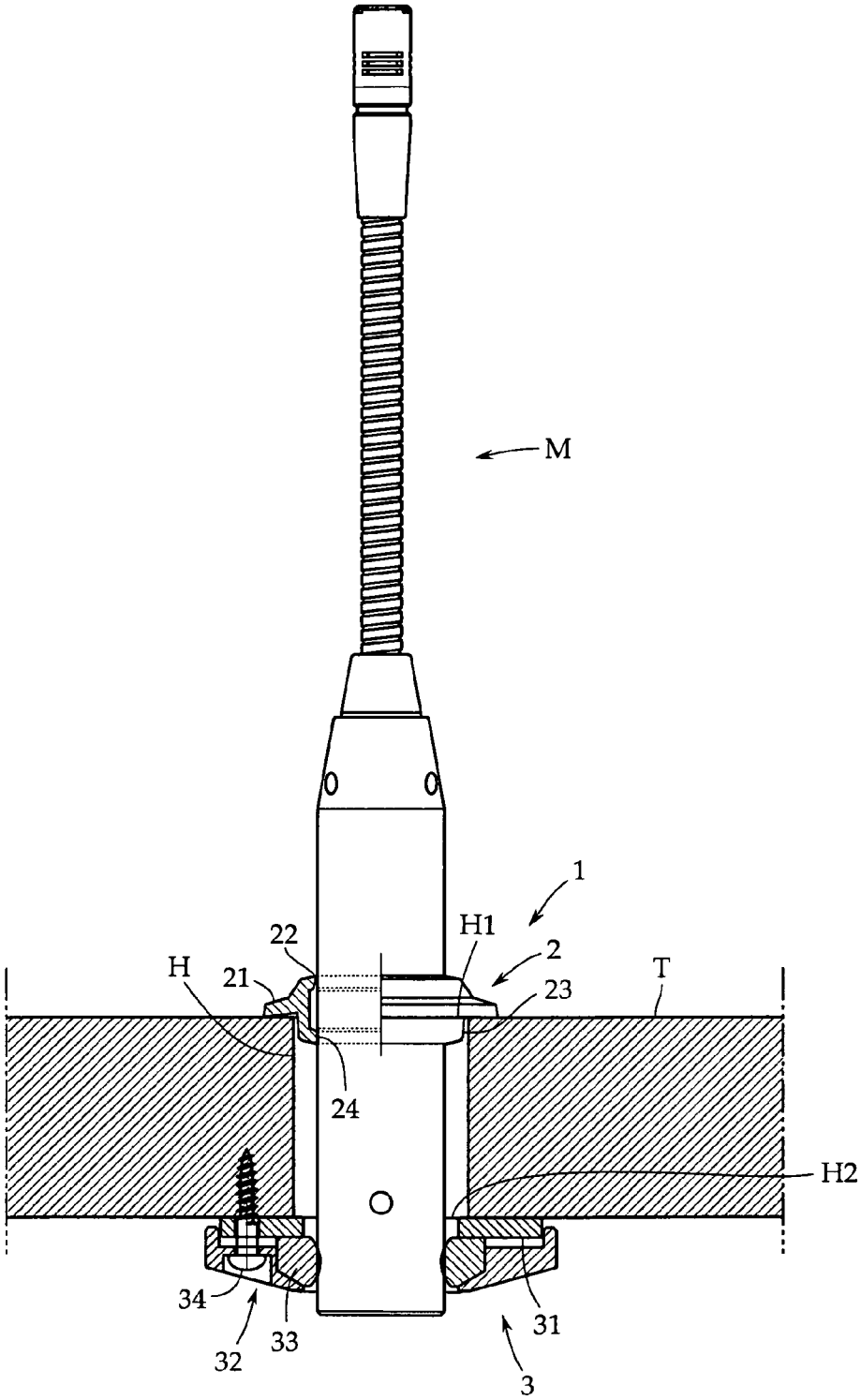
FIG. 8 (RELATED ART)
FIG. 8 is a sectional view of a conventional microphone mounter, showing a used state.
Figure 9:
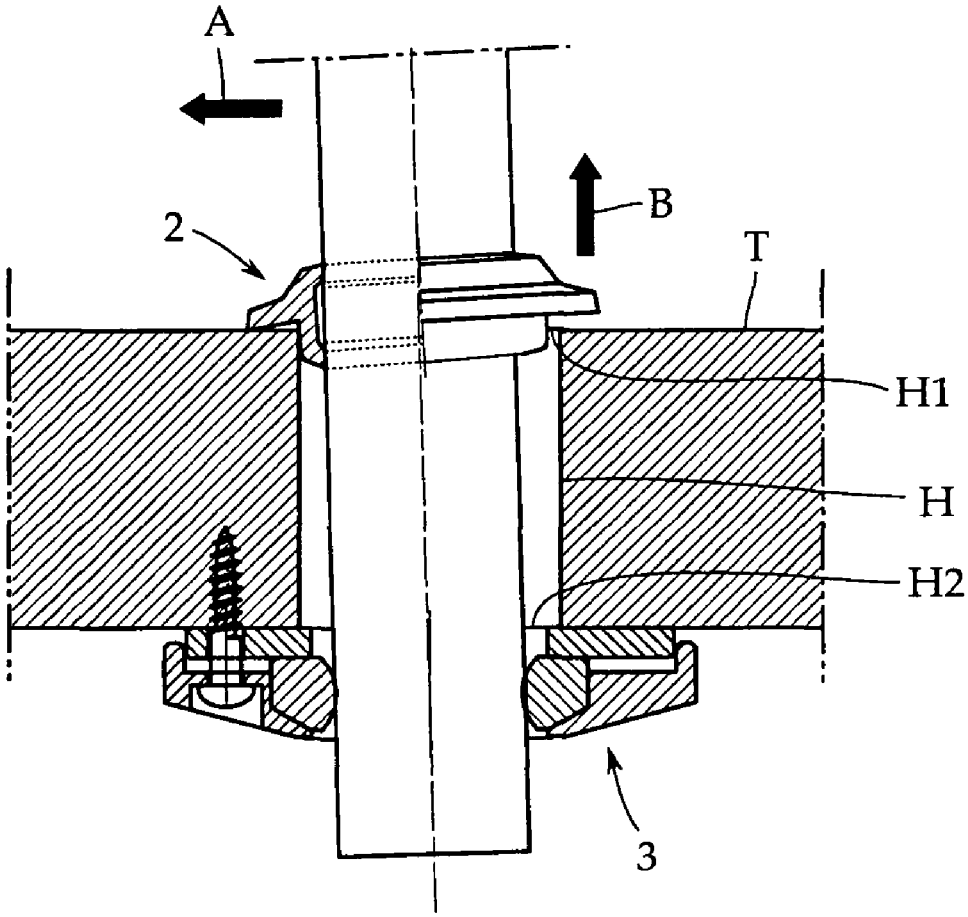
FIG. 9 (RELATED ART)
FIG. 9 is an explanatory view for explaining the movement of a conventional mounter.

As another example of anchor part, as shown in FIG. 7, an anchor part 25 is formed so as to have a ⊿-shaped cross section such that the anchor part 25 tilts slantwise downward substantially in a straight line from the outer periphery side to the inner periphery side so that an inner peripheral surface 252 projects downward as compared with an outer peripheral surface 251.

In this configuration as well, if the anchor part 25 is compressed by the compressive stress (in the direction indicated by the arrows C), since the outer peripheral surface 251 serves as a supporting point, the tip end part of the sleeve 23, which is a point of application, moves downward through a distance of ΔT. Thereby, a downward pulling force (in the direction indicated by the arrow D) is applied to the sleeve 23.

The present application is based on, and claims priority from, Japanese Application Serial Number JP2007-232243, filed Sep. 7, 2007, the disclosure of which is hereby incorporated by reference herein in its entirety.

The invention claimed is:

1. A microphone mounter comprising:

a first fixture adapted to be attached to an upper opening of a mounting hole formed in an installation place, and a second fixture adapted to be attached to a lower opening of the mounting hole, so that a microphone is installed in the mounting hole via the first and second fixtures, wherein the first fixture comprises:

a flange part having a diameter larger than a diameter of the upper opening and provided with an insertion hole, through which the microphone is inserted, in a center thereof, a sleeve projecting from a lower surface of the flange part to be inserted in the mounting hole in a noncontact manner, and an anchor part integrally formed at an end of the sleeve opposite to the flange part, and having an outer peripheral surface adapted to touch an inner peripheral surface of the mounting hole and an inner peripheral surface adapted to touch an outer peripheral surface of the microphone, said outer peripheral surface projecting outwardly from the end of the sleeve to the mounting hole.

2. The microphone mounter according to claim 1, wherein a part of the anchor part ranging from the outer peripheral surface of the anchor part to the inner peripheral surface of the anchor part is positioned below a position of the outer peripheral surface of the anchor part.

3. The microphone mounter according to claim 1, wherein the first fixture is formed of a vibration-proof rubber.

4. The microphone mounter according to claim 1, wherein when a friction coefficient between the outer peripheral surface of the anchor part and the inner peripheral surface of the mounting hole is taken as μ1 and a friction coefficient between the inner peripheral surface of the anchor part and the microphone is taken as μ2, a frictional resistance of the anchor part is set so that μ1>μ2.

5. The microphone mounter according to claim 1, wherein the second fixture has a base ring arranged along the outer periphery of the lower opening, a pressing ring arranged so as to cover the base ring, and an elastically deformable elastic ring held between the base ring and the pressing ring on the inner peripheral surface side thereof; and a part of the elastic ring is elastically deformed by pressing the pressing ring onto the base ring side via a predetermined pressing means to support the microphone.

6. The microphone mounter according to claim 1, wherein the outer peripheral surface is spaced from an outer surface of the sleeve.

7. A microphone mounter having a first fixture attached to an upper opening of a mounting hole formed in an installation surface of a table and a second fixture attached to a lower opening of the mounting hole, so that a microphone is installed in the mounting hole via the first and second fixtures, wherein the first fixture has a flange part having a diameter larger than a diameter of the upper opening and provided with an insertion hole, through which the microphone is inserted, in a center thereof, and a sleeve which is provided projectingly from a lower surface of the flange part and is inserted in the mounting hole in a noncontact manner; at a tip end of the sleeve, an anchor part, an outer peripheral surface of which touches along an inner peripheral surface of the mounting hole and an inner peripheral surface of which touches along an outer peripheral surface of the microphone, is provided integrally; and when the microphone is moved, the anchor part converts deformation stress applied to the anchor part into downward moment, and wherein the anchor part is formed so as to have an umbrella-shaped cross section in which the outer peripheral surface and the inner peripheral surface of the anchor part tilt to the upper opening with the tip end of the sleeve being a vertex.

8. A microphone mounter having a first fixture attached to an upper opening of a mounting hole formed in an installation surface of a table and a second fixture attached to a lower opening of the mounting hole, so that a microphone is installed in the mounting hole via the first and second fixtures, wherein the first fixture has a flange part having a diameter larger than a diameter of the upper opening and provided with an insertion hole, through which the microphone is inserted, in a center thereof, and a sleeve which is provided projectingly from a lower surface of the flange part and is inserted in the mounting hole in a noncontact manner; at a tip end of the sleeve, an anchor part, an outer peripheral surface of which touches along an inner peripheral surface of the mounting hole and an inner peripheral surface of which touches along an outer peripheral surface of the microphone, is provided integrally; and when the microphone is moved, the anchor part converts deformation stress applied to the anchor part into downward moment, and wherein the anchor part is formed into an umbrella shape in which the outer peripheral surface of the anchor part is positioned on the upper opening, and the inner peripheral surface of the anchor part is formed close to the lower opening.

* * * * *